US008118157B1

(12) United States Patent
Piccolin

(10) Patent No.: US 8,118,157 B1
(45) Date of Patent: Feb. 21, 2012

(54) FIREWORK LAUNCHING PLATFORM APPARATUS

(76) Inventor: Attilio M. Piccolin, Indianapolis, IN (US)

( * ) Notice: Subject to any disclaimer, the term of this patent is extended or adjusted under 35 U.S.C. 154(b) by 280 days.

(21) Appl. No.: 11/944,036

(22) Filed: Nov. 21, 2007

(51) Int. Cl.
*F42B 39/00* (2006.01)

(52) U.S. Cl. ..... 206/3; 102/361; 102/360; 102/343; 206/562; 206/563; 206/557; 206/564; 206/565

(58) Field of Classification Search ..... 206/3, 562, 206/563, 557, 564, 565; 102/361, 360, 343, 102/342
See application file for complete search history.

(56) References Cited

U.S. PATENT DOCUMENTS

| | | | | |
|---|---|---|---|---|
| 1,812,311 | A * | 6/1931 | Wolf | 206/589 |
| 2,087,281 | A * | 7/1937 | Fabrizio | 102/358 |
| 3,731,585 | A * | 5/1973 | Demberg et al. | 86/1.1 |
| 3,905,324 | A * | 9/1975 | English | 116/63 P |
| 4,148,258 | A * | 4/1979 | Powers | 102/343 |
| 4,771,695 | A | 9/1988 | Simpson | |
| 5,429,053 | A * | 7/1995 | Walker | 102/342 |
| 5,450,686 | A * | 9/1995 | La Mura et al. | 42/84 |
| D442,079 | S | 5/2001 | Collar | |
| 6,393,990 | B1 * | 5/2002 | Fagan | 102/342 |
| 6,457,415 | B1 | 10/2002 | Peter Sung Yan | |
| 7,011,220 | B2 | 3/2006 | Deye | |
| 7,086,530 | B2 * | 8/2006 | Price et al. | 206/477 |
| 7,096,790 | B1 | 8/2006 | Wah | |
| 2005/0072330 | A1 | 4/2005 | Whitley | |

* cited by examiner

*Primary Examiner* — J. Gregory Pickett
*Assistant Examiner* — Blaine Neway

(57) ABSTRACT

A firework launching platform apparatus includes a panel that has a top side, a bottom side and a peripheral edge. The panel has a plurality of apertures therein extending into the top side and outwardly of the bottom side. The apertures receive a body of a firework to support the firework in an upright manner. The apertures include primary apertures and secondary apertures. Each of the primary apertures is positioned adjacent to the peripheral edge of the panel. A plurality of channels is positioned in the bottom side of the panel. The channels each extend through the peripheral edge and into one of the primary apertures. Each of the primary apertures is linked by at least one of the channels to the peripheral edge.

2 Claims, 5 Drawing Sheets

FIREWORK LAUNCHING PLATFORM APPARATUS

BACKGROUND OF THE INVENTION

Field of the Invention

The present invention relates to firework supporting devices and more particularly pertains to a new firework supporting device for supporting fireworks in an upright manner to ensure they function properly and to allow for easy fuse lighting of the fireworks.

SUMMARY OF THE INVENTION

The present invention meets the objectives presented above by generally comprising a panel that has a top side, a bottom side and a peripheral edge. The panel has a plurality of apertures therein extending into the top side and outwardly of the bottom side. The apertures receive a body of a firework to support the firework in an upright manner. The apertures include primary apertures and secondary apertures. Each of the primary apertures is positioned adjacent to the peripheral edge of the panel. A plurality of channels is positioned in the bottom side of the panel. The channels each extend through the peripheral edge and into one of the primary apertures. Each of the primary apertures is linked by at least one of the channels to the peripheral edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
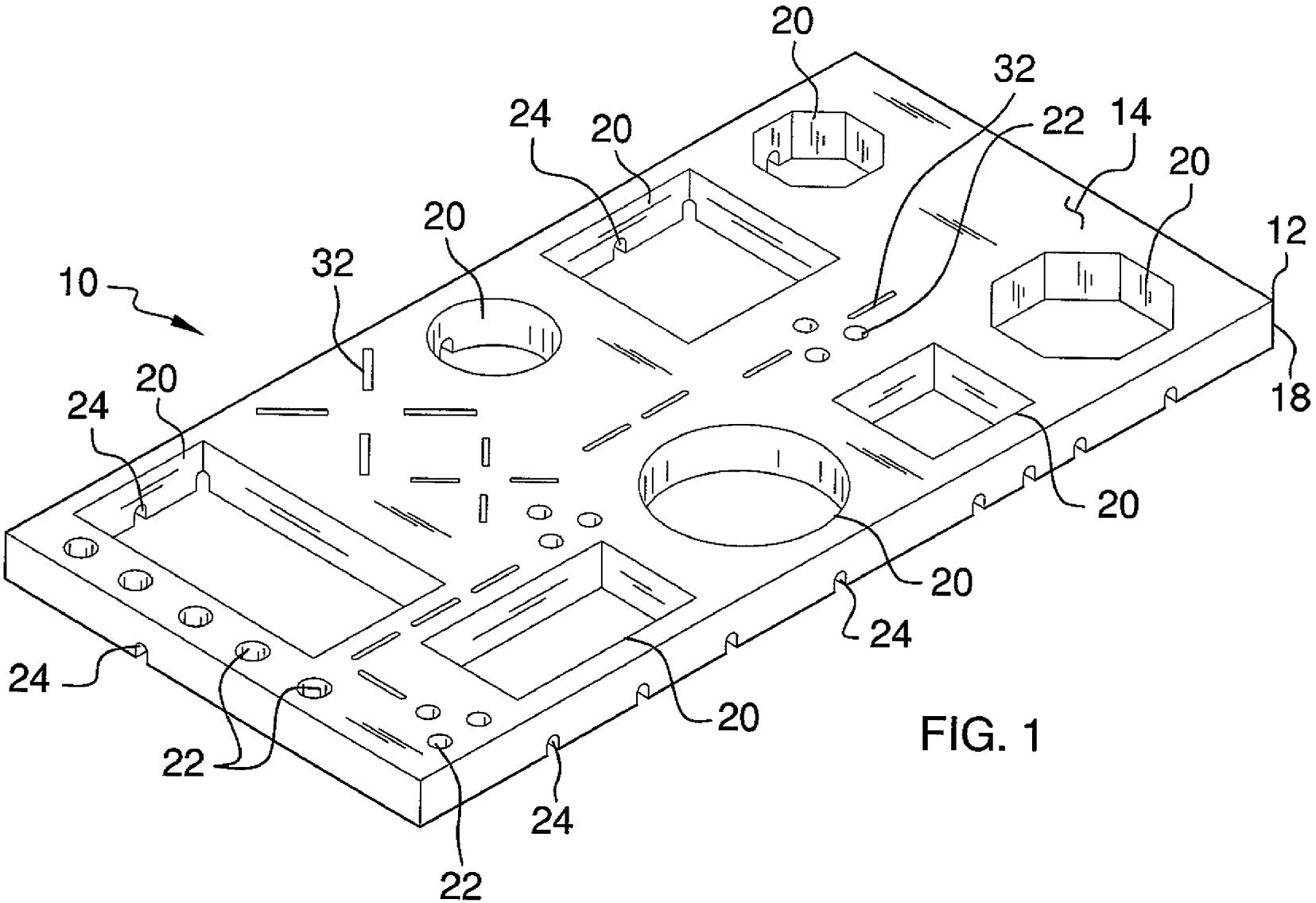
FIG. 1 is a top perspective view of a firework launching platform apparatus according to the present invention.
Figure 2:
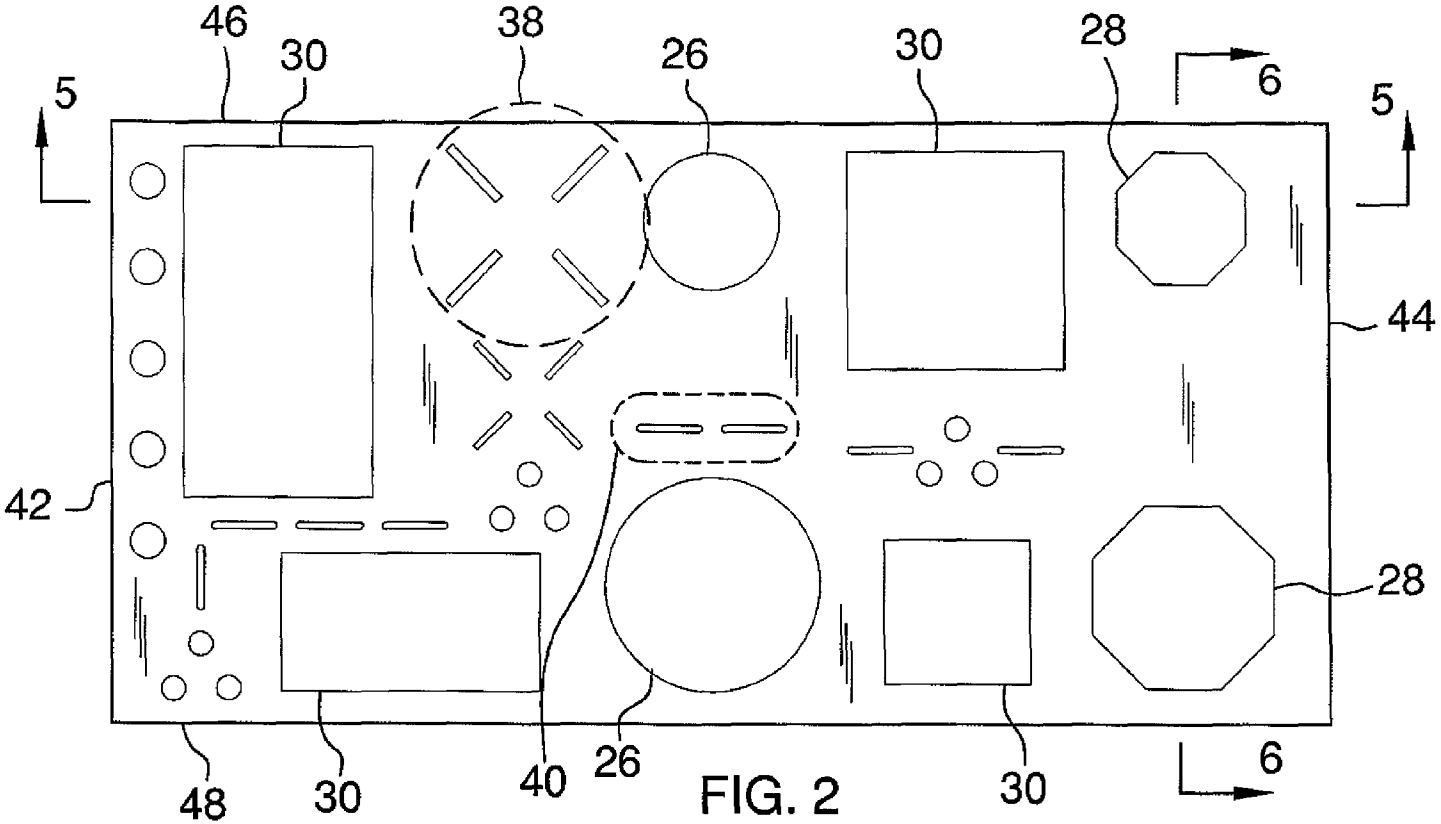
FIG. 2 is a top view of the present invention.
Figure 3:
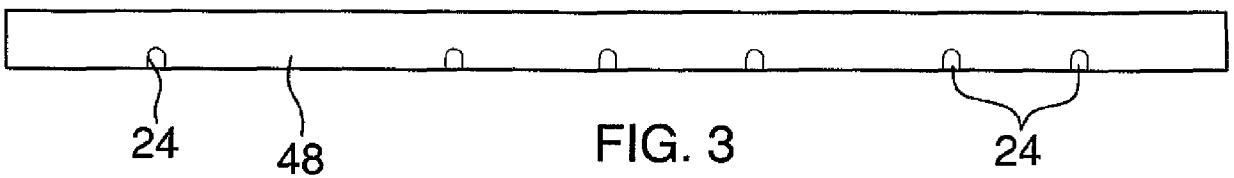
FIG. 3 is a side view of the present invention.
Figure 4:
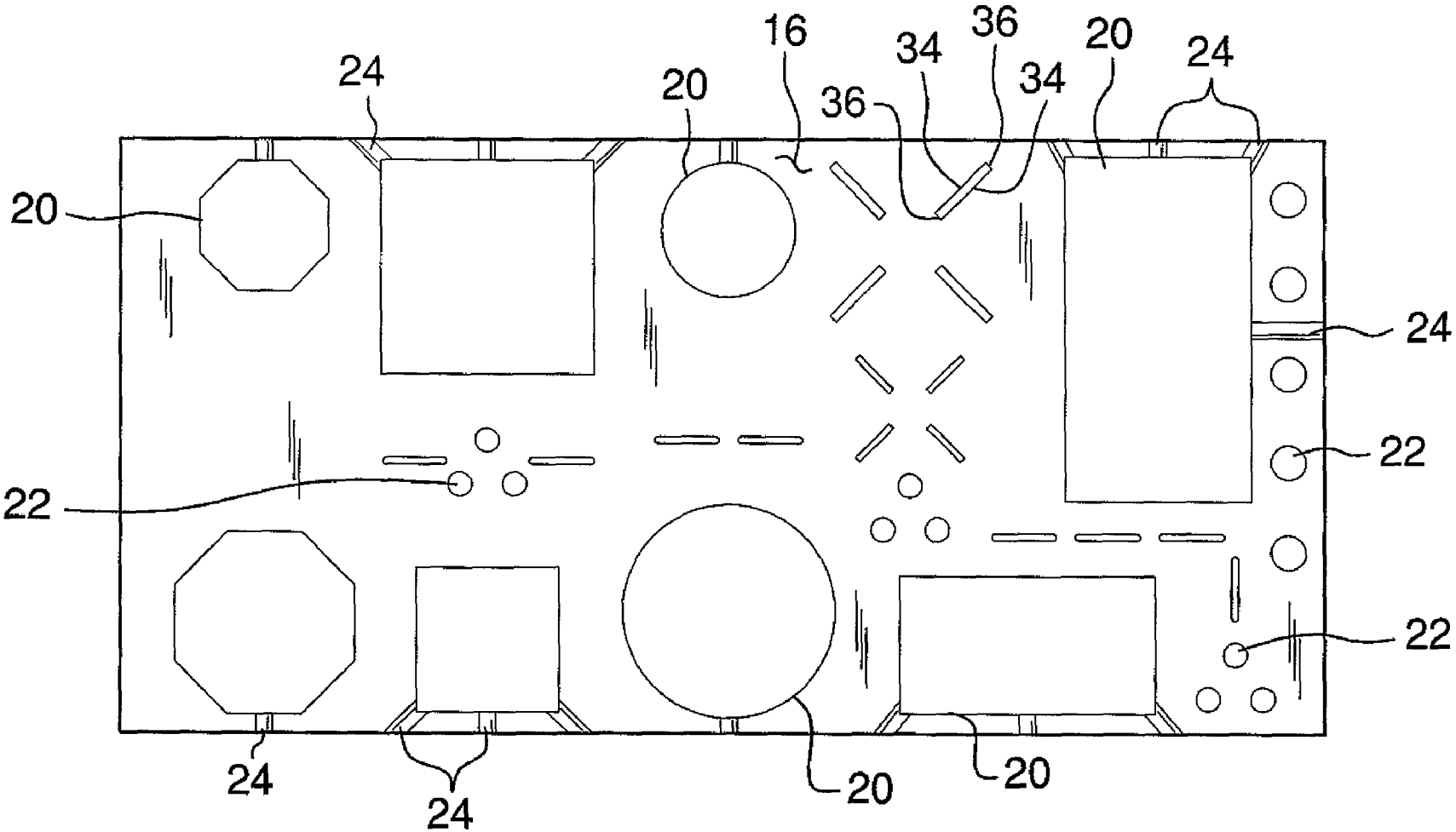
FIG. 4 is a bottom view of the present invention.
Figure 5:
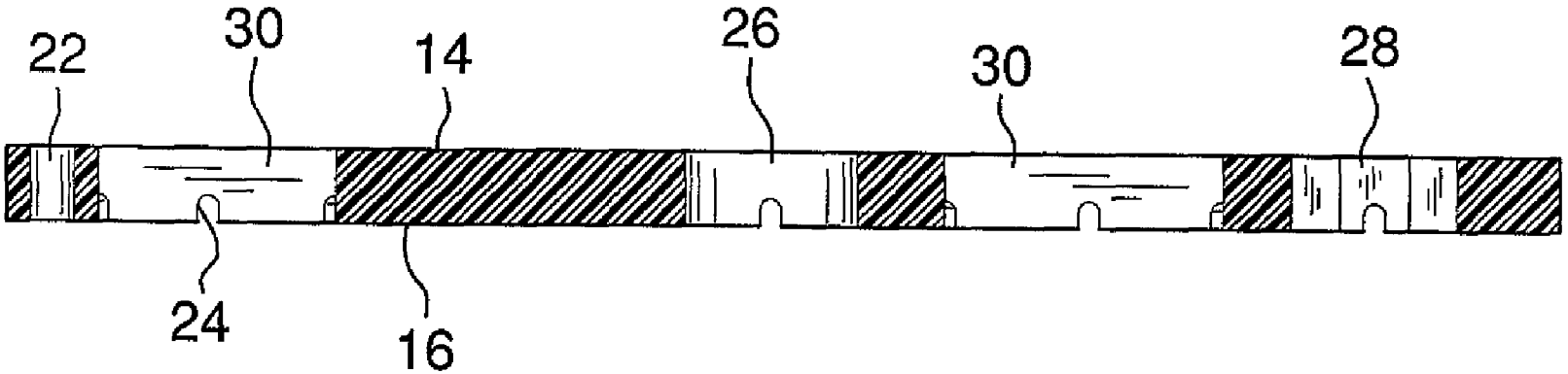
FIG. 5 is a cross-sectional view taken along line 5-5 of FIG. 2 of the present invention.
Figure 6:
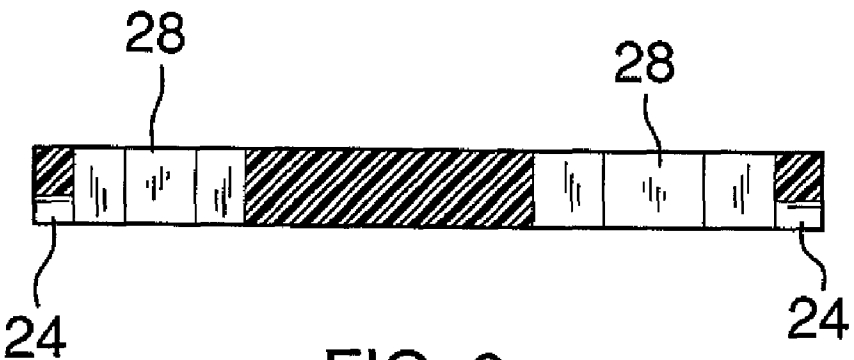
FIG. 6 is a cross-sectional view taken along line 6-6 of FIG. 2 of the present invention.

With reference now to the drawings, and in particular to FIGS. 1 through 7 thereof, a new firework supporting device embodying the principles and concepts of the present invention and generally designated by the reference numeral 10 will be described.

As best illustrated in FIGS. 1 through 7, the firework launching platform apparatus 10 generally comprises a panel 12 that has a top side 14, a bottom side 16 and a peripheral edge 18. The panel 12 is comprised of non-flammable material. The panel 12 has a plurality of apertures therein extending into the top side 14 and outwardly of the bottom side 16. The apertures receive a body of a firework 8 to support the firework 8 in an upright manner. The apertures include primary apertures 20 and secondary apertures 22. Each of the primary apertures 20 is positioned adjacent to the peripheral edge 18 of the panel 12. A plurality of channels 24 is positioned in the bottom side 16 of the panel 12. The channels 24 each extend through the peripheral edge 18 and into one of the primary apertures 20. Each of the primary apertures 20 is linked by at least one of the channels 24 to the peripheral edge 18. The channels 24 receive the fuses 9 of the fireworks 8 so that they can be lit outside of and spaced from the peripheral edge 18 of the panel 12. The secondary apertures 22 are unlinked to the peripheral edge. 18 by any of the channels 24.

The primary apertures 20 include at least two circular apertures 26. At least one of the circular apertures 26 has a diameter approximately equal to 3.5 inches and at least one of the circular apertures 26 has a diameter equal to about 1.75 inches. At least two regular hexagon apertures 28 are provided. The term regular hexagon is used to denote a hexagon having equal length sides and equal angles formed by adjoining ones of the sides. The hexagon apertures 28 have a different size with respect to each other. At least one of the hexagon apertures 28 has a width equal to approximately 5 inches. A plurality of rectangular apertures 30 is also provided. The rectangular apertures 30 include at least two square shaped apertures. One of the square shaped apertures has a length and width equal to approximately 6 inches. The rectangular apertures 30 each have a different size with respect to each other. Each of the hexagon 28 and rectangular 30 apertures may each include a plurality of channels 24 connected thereto wherein some of the channels 24 go to the corners of the rectangular 30 and hexagon 28 apertures.

Figure 7:
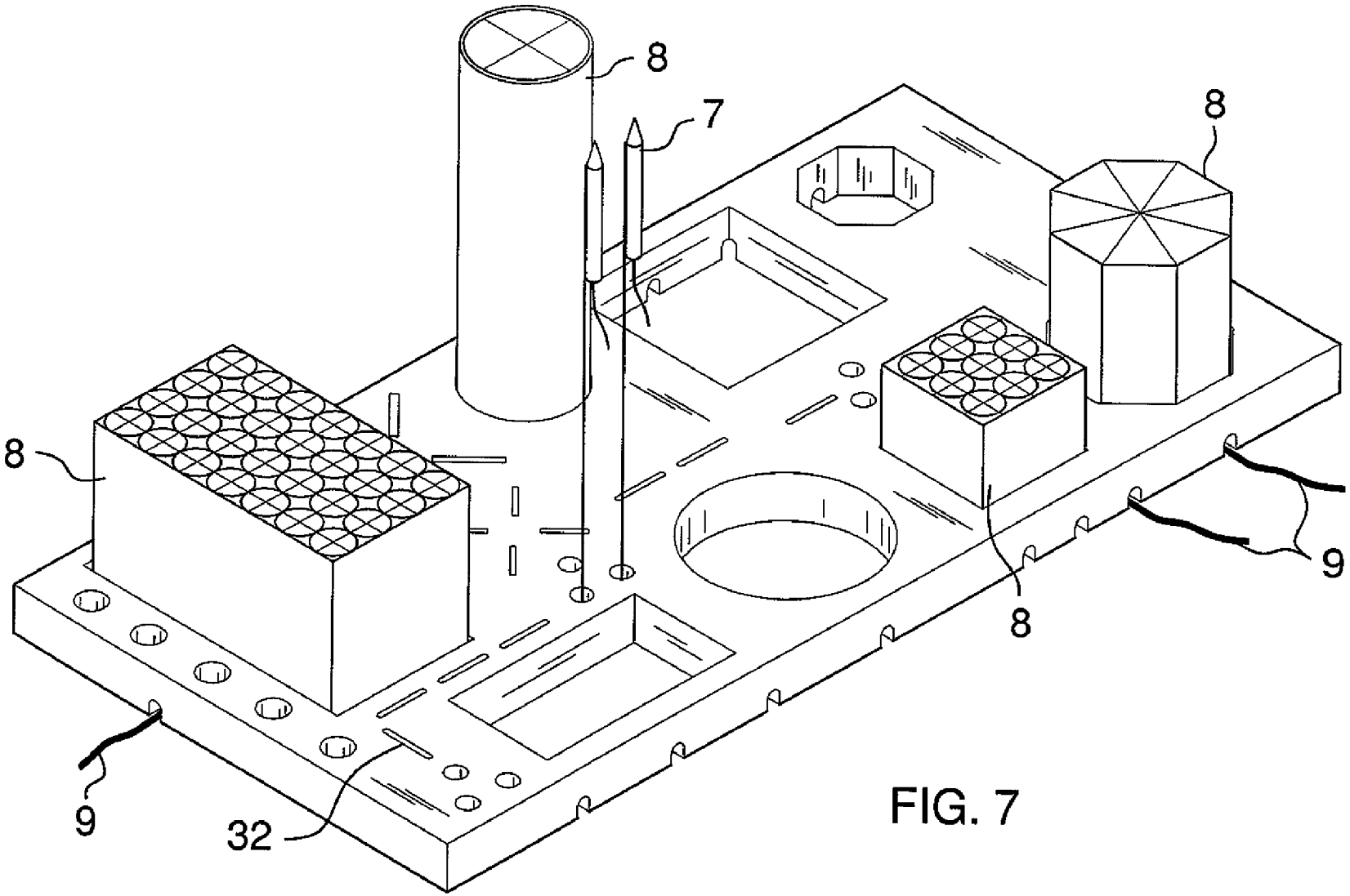
FIG. 7 is a perspective in-use view of the present invention.

The secondary apertures 22 include a plurality of circular apertures each having a smaller diameter than the circular apertures 26 of the primary apertures 20. The secondary apertures 22 each have a diameter less than 1.5 inches and may have a diameter less than 1 inch. The secondary apertures 22 are used for holding bottle rocket 7 type fireworks and the like as shown in FIG. 7.

The panel 12 has a plurality of elongated slots 32 therein extending into the top side 14 and outwardly of the bottom side 16. Each of the slots 32 includes a pair of elongated inner walls 34 and a pair of respectively short end walls 36. The elongated slots 32 include at least four of the elongated slots that are arranged in an X pattern as in the area denoted "38" to receive four equally spaced fins of a rocket. FIG. 1 displays two X-patterns wherein one has a larger size than the other. The elongated slots 32 include at least two of the elongated slots 32 being linearly aligned with each other as in the area denoted "40".

The peripheral edge 18 includes a first edge 42, a second edge 44, a third edge 46 and a fourth edge 48. The first 42 and second 44 edges are positioned opposite of each other. Each of the channels 24 extends from an associated one of the primary apertures 20 to a closest positioned one of the first 42, second 44, third 46 or fourth 48 channels. The panel 12 has a length from the first edge 42 to the second edge 44 greater than 30 inches and a width from the third edge 46 to the fourth edge 48 less than 20 inches. The panel 12 has a height from the top side 14 to the bottom side 16 between 1 inch and 3 inches.

In use, a variety of fireworks 8 having different sizes are positioned in the panel 12. The varying shapes of the primary apertures 20 allows for block and cylinder type containers holding a plurality of fireworks to be supported in the panel 12. The sizes used for the primary apertures 20 can be chosen to match popular firework containers to ensure a secure fit between the edges of the primary apertures and the firework 8 containers. The channels 24 ensure that the fuses 9 are easily accessible even though a bottom of the fireworks 8 is hidden by the panel 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fireworks launching platform apparatus for supporting fireworks to be fired upwardly from the apparatus, said apparatus comprising:

a panel having a top side, a bottom side and a peripheral edge, said panel having a plurality of apertures therein extending into said top side and outwardly of said bottom side, said bottom side being abuttable on a ground surface, said bottom side facing in an opposite direction with respect to said top side, wherein a body of a firework is receivable by said apertures to support the firework in an upright manner, said apertures including primary apertures and secondary apertures each extending through said top and bottom sides, each of said primary apertures being positioned adjacent to said peripheral edge of said panel, a plurality of channels being positioned in said bottom side of said panel, said channels each extending through said peripheral edge and into one of said primary apertures, each of said primary apertures being linked by at least one of said channels to said peripheral edge, said secondary apertures being unlinked to said peripheral edge by any of said channels, said primary apertures including;

at least two circular apertures, at least one of said circular apertures having a diameter approximately equal to 3.5 inches, at least one of said circular apertures having a diameter equal to about 1.75 inches;

at least two regular hexagon apertures, said hexagon apertures having a different size with respect to each other, at least one of said hexagon apertures having a width equal to approximately 5 inches;

a plurality of rectangular apertures, said rectangular apertures including at least two square shaped apertures, one of said square shaped apertures having a length and width equal to approximately 6 inches, said rectangular apertures each having a different size with respect to each other;

said secondary apertures including a plurality of circular apertures each having a smaller diameter than said circular apertures of said primary apertures, said secondary apertures each having a diameter less than 1.5 inches;

said panel having a plurality of elongated slots therein extending into said top side and outwardly of said bottom side, each of said slots including a pair of elongated inner walls and a pair of respectively short end walls, said elongated slots including at least four of said elongated slots being arranged in an X pattern, wherein four equally spaced fins of a rocket are receivable by said slots arranged in said X pattern, said elongated slots including at least two of said elongated slots being linearly aligned with each other; and said peripheral edge including a first edge, a second edge, a third edge and a fourth edge, said first and second edges being positioned opposite of each other, each of said channels extending from an associated one of said primary apertures to a closest positioned one of said first, second, third or fourth channels, said panel having a length from said first edge to said second edge greater than 30 inches, said panel having a width from said third edge to said fourth edge less than 20 inches, said panel having a height from said top side to said bottom side between 1 inch and 3 inches.

2. A fireworks launching platform apparatus for supporting fireworks to be fired upwardly from the apparatus, said apparatus comprising:

a panel having a top side, a bottom side and a peripheral edge, said panel having a plurality of apertures therein extending into said top side and outwardly of said bottom side, said bottom side being abuttable on a ground surface, said bottom side facing in an opposite direction with respect to said top side, wherein a body of a firework is receivable by said apertures to support the firework in an upright manner, said apertures including primary apertures and secondary apertures each extending through said top and bottom sides, each of said primary apertures being positioned adjacent to said peripheral edge of said panel, a plurality of channels being positioned in said bottom side of said panel, said channels each extending through said peripheral edge and into one of said primary apertures, each of said primary apertures being linked by at least one of said channels to said peripheral edge;

at least two circular apertures;

at least two regular hexagon apertures;

a plurality of rectangular apertures, said rectangular apertures including at least two square shaped apertures;

said secondary apertures including a plurality of circular apertures each having a smaller diameter than said circular apertures of said primary apertures;

said panel having a plurality of elongated slots therein extending into said top side and outwardly of said bottom side, said elongated slots including at least four of said elongated slots being arranged in an X pattern, wherein four equally spaced fins of a rocket are receivable by said slots arranged in said X pattern, said elongated slots including at least two of said elongated slots being linearly aligned with each other.

* * * * *